US011384663B2

(12) United States Patent
Abu Mustafa et al.

(10) Patent No.: US 11,384,663 B2
(45) Date of Patent: Jul. 12, 2022

(54) COOLING LUBRICATION SYSTEM COMPRISING A DRY SUMP

(71) Applicant: Hanon Systems Bad Homburg GmbH, Bad Homburg V. D. Höhe (DE)

(72) Inventors: Anwar Abu Mustafa, Darmstadt (DE); Boris Rinn, Heuchelheim (DE)

(73) Assignee: Hanon Systems Bad Homburg GmbH, Bad Homburg V. D. Höhe (DE)

( * ) Notice: Subject to any disclaimer, the term of this patent is extended or adjusted under 35 U.S.C. 154(b) by 253 days.

(21) Appl. No.: 16/787,709

(22) Filed: Feb. 11, 2020

(65) Prior Publication Data

US 2020/0256221 A1 Aug. 13, 2020

(30) Foreign Application Priority Data

Feb. 13, 2019 (DE) ..... 10 2019 201 863.7

(51) Int. Cl.
*F01M 11/00* (2006.01)

(52) U.S. Cl.
CPC . *F01M 11/0004* (2013.01); *F01M 2011/0075* (2013.01); *F01M 2011/0079* (2013.01); *F01M 2011/0083* (2013.01)

(58) Field of Classification Search
CPC ..... F01M 11/0004; F01M 2011/0075; F01M 2011/0079; F01M 2011/0083; F01M 1/02; F01M 2011/0095
See application file for complete search history.

(56) References Cited

U.S. PATENT DOCUMENTS

| | | | | |
|---|---|---|---|---|
| 5,586,875 | A | 12/1996 | Ondrejko et al. | |
| 5,842,837 | A | 12/1998 | Nakayoshi et al. | |
| 6,314,934 | B1 | 11/2001 | Ito et al. | |
| 6,579,070 | B1 | 6/2003 | Birkenmaier et al. | |
| 6,679,692 | B1 | 1/2004 | Feuling | |
| 2013/0333980 | A1* | 12/2013 | Tsunashima | F01M 1/02 184/6.5 |
| 2017/0058895 | A1* | 3/2017 | Schultz | F04C 15/0073 |
| 2017/0211572 | A1* | 7/2017 | Jeong | F04C 15/008 |
| 2020/0300132 | A1* | 9/2020 | Gatti | F01M 11/0004 |

FOREIGN PATENT DOCUMENTS

| | | | |
|---|---|---|---|
| DE | 10034400 | * | 1/2002 |
| DE | 10043801 | A1 | 3/2002 |
| DE | 10247518 | A1 | 4/2003 |
| DE | 102005022161 | A1 | 11/2006 |

(Continued)

OTHER PUBLICATIONS

U.S. Appl. No. 16/787,770, filed Feb. 11, 2020, Anwar Abu Mustafa.

(Continued)

*Primary Examiner* — Syed O Hasan
(74) *Attorney, Agent, or Firm* — Harness, Dickey & Pierce, P.L.C.

(57) ABSTRACT

A cooling lubrication system comprises a dry sump, an oil tank, and a pump system that operates an oil circuit in which an oil pump delivers oil from the dry sump into the oil tank, and the pump system comprises a vane cell pump and a gerotor pump on a shaft.

3 Claims, 2 Drawing Sheets

(56) References Cited

FOREIGN PATENT DOCUMENTS

| | | | |
|---|---|---|---|
| DE | 102006017924 | A1 | 10/2007 |
| DE | 112011104423 | A5 | 9/2013 |
| DE | 102014222321 | B3 | 12/2015 |
| DE | 102016120502 | A1 | 5/2017 |
| DE | 102016206654 | A1 | 10/2017 |
| DE | 102016121241 | B4 | 9/2018 |
| DE | 102018113297 | A1 | 12/2018 |
| EP | 1522732 | A2 | 4/2005 |
| EP | 2589851 | A2 | 5/2013 |
| FR | 2673675 | A1 | 9/1992 |
| GB | 1299474 | A | 12/1972 |
| JP | H01117906 | A | 5/1989 |
| JP | H0317213 | U | 2/1991 |
| JP | H0710483 | U | 2/1995 |
| JP | 2002371972 | A | 12/2002 |
| JP | 2003307186 | A | 10/2003 |
| JP | 2005076512 | A | 3/2005 |
| JP | 2014 077461 | A | 5/2014 |
| JP | 2018 003774 | A | 1/2018 |
| WO | 2006122687 | A1 | 11/2006 |
| WO | WO-2012079573 | A2 | 6/2012 |

OTHER PUBLICATIONS

Office Action regarding German Patent Application (with English Translation) No. 102019201863.7, dated Sep. 6, 2019.
Office Action regarding German Patent Application (With English Translation) No. 102019201864.5, dated Oct. 19, 2020.
Office Action regarding Hungarian Patent Application (With English Translation) No. P2000048, dated Oct. 27, 2020.
Office Action regarding Chinese Office Action regarding Patent Application No. 202010088245X, dated Mar. 3, 2022.
Japanese Office Action regarding Application No. 202002253.4, dated Dec. 21, 2021.
Notice of Opinion Submission (with English Translation) regarding German Patent Application 10/2020/0013974, dated Mar. 11, 2021.
Notice of Opinion Submission (With English Translation) regarding Korean Application No. 1020200013973, dated Mar. 11, 2021.

* cited by examiner

COOLING LUBRICATION SYSTEM COMPRISING A DRY SUMP

CROSS-REFERENCE TO RELATED APPLICATIONS

This application claims the benefit and priority of German Patent Application No. 10 2019 201 863.7 filed on Feb. 13, 2019. The entire disclosure of the above application is incorporated herein by reference.

FIELD

The invention relates to a cooling lubrication system comprising a dry sump and an oil tank, wherein a pump system operates the oil circuit in which an oil pump delivers oil from the dry sump into the oil tank.

BACKGROUND

A dry-sump lubrication for four-wheeled vehicles had only been provided for sports and racing cars and for extreme terrain cars—this is currently changing.

In dry-sump lubrication, the lubricating oil is carried in an oil tank and delivered to the lubrication points by means of pressure pumps. In contrast to wet-sump lubrication, the lubricating oil dripping off the lubricating points, which is partially foamed, is sucked off from the oil sump and various collection points by means of further suction pumps. The air is then separated and the oil is returned to the oil tank.

A general advantage of dry-sump lubrication pumps is the reduction of the installation height. For example, the engine can be mounted deeper in vehicles owing to the lower design of the oil sump. The center of gravity of the vehicle decreases by this and driving stability is increased. Moreover, the engine is better cooled since larger quantities of oil are in circulation.

Dry-sump lubrication requires at least a second oil pump and a reservoir for wet-sump lubrication.

The realization of a cooling lubrication system with a dry sump thus requires an optimum use of pumps.

Known from DE 102 47 518 A1 is a vane cell pump comprising a rotor driven by a drive shaft, which is rotatably disposed inside a stroke ring between two end plates and in the circumferential surface of which are provided essentially radially extending slots, in which vanes are arranged in a radially displaceable manner in order to deliver fluid from a suction area to a pressure area, the suction area being connected to at least one suction kidney and the pressure area being connected to at least one pressure kidney which are formed in one of the end plates in which under-vane grooves are formed radially inside the area between the suction kidney and the pressure kidney, which are connected to under-vane chambers provided in the slots, the under-vane groove disposed in the area of the pressure kidney being connected to the pressure kidney.

In conventional vane cell pumps, all of the under-vane grooves are subjected to high-pressure so as to ensure the retraction movement of the vanes and to keep the vane heads resting on the inner face of the stroke ring. According to DE 102 47 518 A1, only the under-vane grooves located in the pressure area are connected to the pressure kidney and are thus subjected to high pressure. The under-vane grooves located in the suction area are not connected to the pressure kidney, but to the pressure chamber of an additional delivery device. The additional delivery device is designed to maintain sufficient pressure in the connected under-vane grooves, which, however, is significantly lower than the pressure in the pressure area of the vane cell machine. Such an integrated delivery device is a gerotor pump which delivers oil from a tank to a pressure connection channel and finally to the under-vane grooves.

Double-flow vane cell pumps are also known, for example, from DE 11 2011 104423 A5, in which the flows are used independently of each other.

SUMMARY

It is the object of the invention to provide a cooling lubrication system comprising a dry sump with optimized pumps.

The object is solved by means of a cooling lubrication system comprising a dry sump and an oil tank, wherein a pump system operates the oil circuit in which an oil pump delivers oil from the dry sump into the oil tank, with the pump system comprising a vane cell pump and a gerotor pump on a shaft.

Owing to the common drive by an electric machine on a common shaft, the pump system can be structurally configured such that it is very small.

It is an advantage that the vane cell pump is of double-flow design and comprises two independent suction points in the dry sump.

Thus, one pump solves the problem that the dry sump must be pumped out at several points, and the use of multiple oil pumps is avoided.

Advantageously, the double-flow vane cell pump comprises a first pressure outlet and a second pressure outlet, with which the oil is delivered as volume flow into an oil tank and to a consumer.

It is an advantage that the gerotor pump is connected on the pressure outlet side to under-vane grooves in the vane cell pump, thus eliminating initial problems of the vane cell pump.

Advantageously, the gerotor pump supplies on the pressure side a cooling for an electric machine.

FIGURES

DETAILED DESCRIPTION

Figure 1:
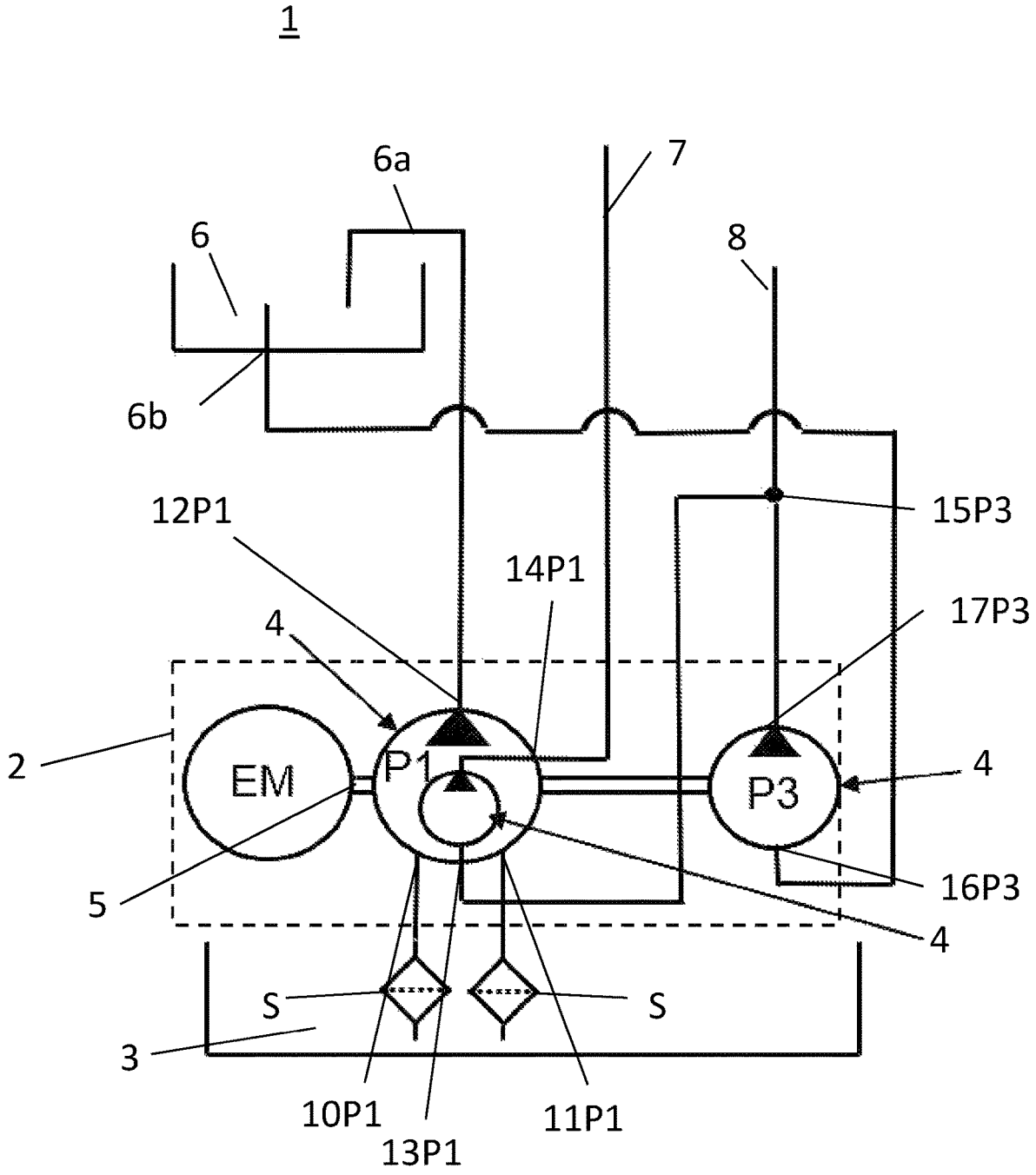
FIG. 1 shows an inventive embodiment of the cooling lubrication system with a dry sump.

FIG. 1 shows a cooling lubrication system 1 equipped with a dry sump 3 and an oil tank 6, with a pump system 2 ensuring the circulation of the lubricant.

The pump system 2 consists of three pumps 4 driven on a common shaft 5 by a common electric machine EM.

The pump P1 comprises two suction ports 10 P1 and 11 P1. The pump P1 sucks the oil from the dry sump 3 at two points and delivers the oil into the oil tank 6 via the pressure outlet 12 P1 and the oil tank inlet 6*a*.

The two suction points S in the dry sump 3 independently suck oil from the dry sump such that one of the two suction points S still delivers oil, even if the other suction point already sucks air or an air-oil mixture.

The pump P1 is a vane cell pump of a double-flow design, with the two flows being configured separately from each other. In this way, two separate delivery circuits are created which are each connected to a suction point S in the dry sump 3. The two delivery circuits are connected to each other on the pressure side.

Disposed adjacent to the vane cell pump P1, on the same shaft 5, is a gerotor pump P3. The gerotor pump P3 delivers oil from the oil tank 6 via the port 6*b* and the pump inlet 16P3, for example for cooling an electric machine 8.

The supply of the consumers, the gear and the electric machine is merely an example since further consumers are also conceivable.

In the pump system 2, the gerotor pump P3 is also used, in addition to its delivery function, for cooling an electric machine in order to preload the vane cell pump P1 in terms of pressure. In vane cell pumps, the problem arises that during start-up the vanes of the vane cell pump do not initially rest on the stroke ring, thus impairing the efficiency of the pump. To prevent this, a vane cell pump comprising at least one under-vane groove is used, into which oil is fed at a specific pressure such that the vanes are brought towards the stroke ring.

The gerotor pump P3 therefore comprises at its pump outlet a branch 15 P3 with which oil is applied under pressure to the inlet 13 P1 of the under-vane grooves 30 of the vane cell pump P1.

The under-vane grooves 30 are further connected to a pressure outlet 14P1 which provides the oil supply for a gear.

A complicated integrated gerotor pump in the vane cell pump, as suggested in prior art, is thus avoided. The vane cell pump P1 thus comprises two separate suction points S and two separate pressure areas which, on the one hand, fill an oil tank 6 and, on the other hand, provide the oil supply for a gear 7. The pump system 2 allows a small construction and thus a reduction of costs.

Figure 2:
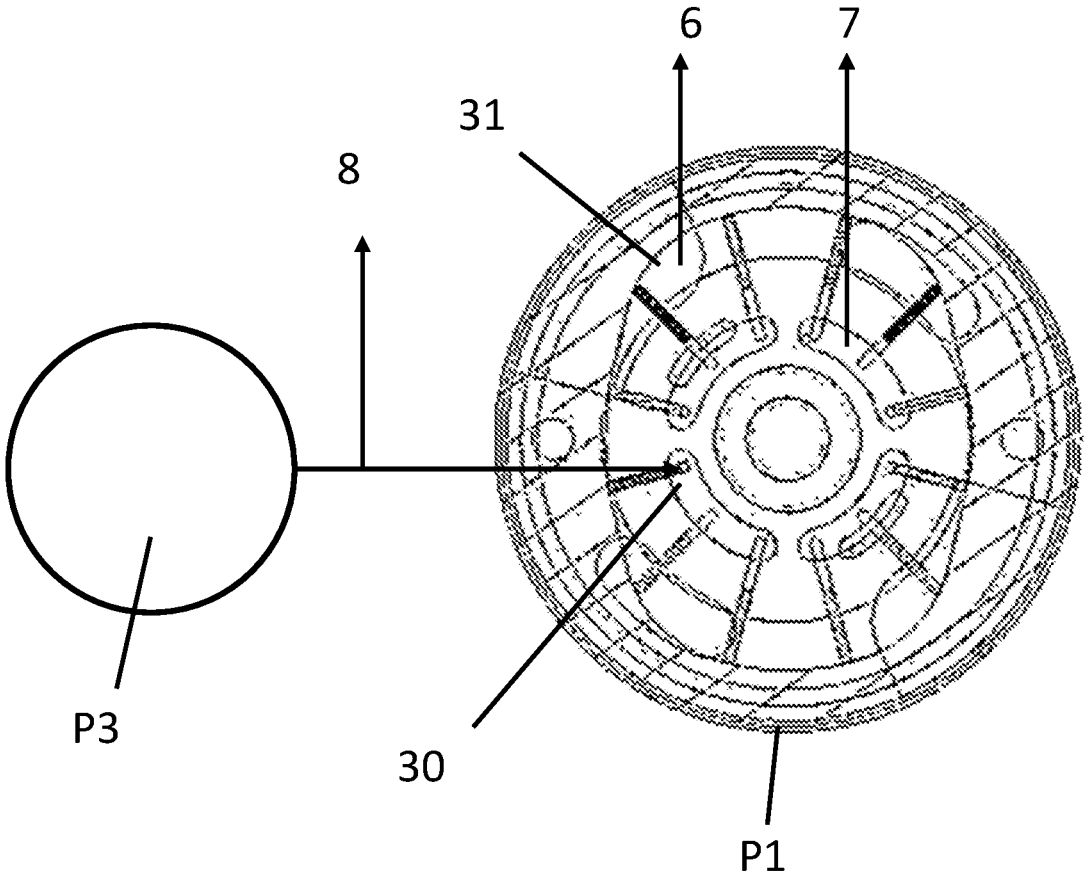
FIG. 2 shows an embodiment for two pumps.

FIG. 2 schematically demonstrates how the two pumps P1 and P3 are connected to each other. Via the branch 15 P3, the gerotor pump P3 is on the outlet side connected to the inlet 13P1 to the under-vane area of the vane cell pump P1. Starting from the branch 15 P3, the gerotor pump P3 feeds in oil for cooling the electric machine 8.

The under-vane grooves 30 are thus connected to the gerotor pump P3 and also on the outlet side to the oil supply for a gear 7. The usual pressure outlet 31 of the pump is connected to the oil tank 6.

What is claimed is:

1. A cooling lubrication system comprising: a dry sump, an oil tank, and a pump system that operates an oil circuit in which an oil pump delivers oil from the dry sump into the oil tank, wherein the pump system comprises a vane cell pump and a gerotor pump on a shaft, wherein the gerotor pump is connected on a pressure outlet side to under-vane grooves in the vane cell pump and to a cooling for an electric machine.

2. The cooling lubrication system according to claim 1, wherein the vane cell pump is of a double-flow design and comprises two independent suction points in the dry sump.

3. The cooling lubrication system according to claim 2, wherein the double-flow vane cell pump comprises a first pressure outlet and a second pressure outlet starting from the under-vane grooves.

* * * * *